US012060767B2

(12) United States Patent
Hunnicutt et al.

(10) Patent No.: US 12,060,767 B2
(45) Date of Patent: Aug. 13, 2024

(54) ACTUATOR WITH EMBEDDED MONITORING AND OPTIMIZING FUNCTIONALITY

(71) Applicant: A-T Controls, Inc., Cincinnati, OH (US)

(72) Inventors: Ryan Hunnicutt, Cypress, TX (US); Celso Siado, Houston, TX (US)

(73) Assignee: A-T Controls, Inc., Cincinnati, OH (US)

( * ) Notice: Subject to any disclaimer, the term of this patent is extended or adjusted under 35 U.S.C. 154(b) by 73 days.

(21) Appl. No.: 18/060,440

(22) Filed: Nov. 30, 2022

(65) Prior Publication Data

US 2024/0175334 A1 May 30, 2024

(51) Int. Cl.

| | |
|---|---|
| ***E21B 34/06*** | (2006.01) |
| ***E21B 43/16*** | (2006.01) |
| ***E21B 47/008*** | (2012.01) |

(52) U.S. Cl.

CPC ..... *E21B 34/066* (2013.01); *E21B 43/168* (2013.01); *E21B 47/008* (2020.05)

(58) Field of Classification Search

None

See application file for complete search history.

(56) References Cited

U.S. PATENT DOCUMENTS

| | | | | |
|---|---|---|---|---|
| 2003/0051881 | A1 | 3/2003 | Vinegar et al. | |
| 2015/0090442 | A1* | 4/2015 | Lastra | E21B 43/122 166/250.01 |
| 2018/0149003 | A1* | 5/2018 | Xiao | E21B 43/121 |
| 2019/0353016 | A1* | 11/2019 | Sandidge | E21B 43/123 |
| 2020/0284122 | A1 | 9/2020 | Golden et al. | |
| 2021/0023296 | A1 | 1/2021 | Langenfeld et al. | |
| 2021/0198557 | A1 | 7/2021 | Nizamidin et al. | |
| 2021/0372241 | A1 | 12/2021 | Zahran | |

FOREIGN PATENT DOCUMENTS

| | | |
|---|---|---|
| WO | 2021259519 | 12/2021 |

OTHER PUBLICATIONS

"International Application Serial No. PCT US2023 081189, International Search Report mailed Mar. 13, 2024", 2 pgs.

"International Application Serial No. PCT US2023 081189, Written Opinion mailed Mar. 13, 2024", 6 pgs.

* cited by examiner

*Primary Examiner* — Charles R Nold

(74) *Attorney, Agent, or Firm* — Schwegman Lundberg & Woessner, P.A.

(57) ABSTRACT

An actuator with an embedded motherboard is provided. Firmware on the motherboard executes a kickoff mode to bring an oil well online by controlling a control valve of a gas injection line to change pressures and gas flow rates in the injection line. The kickoff mode includes four phases based on the gas flow rates and pressures associated with the gas injection line. Firmware also executes an optimization mode that optimally finds a bottom hole pressure for the oil well by decreasing and increasing the gas injection rates. The optimization mode can continuously be executed after kickoff exits to maintain optimal oil extraction and bottom hole pressures for the well. Firmware further executes a well protection mode that continuously monitors current pressures and flow rates and jumps directly to a needed phase of kickoff based thereon.

20 Claims, 6 Drawing Sheets

ACTUATOR WITH EMBEDDED MONITORING AND OPTIMIZING FUNCTIONALITY

BACKGROUND

There a many types of actuators, an actuator converts energy into torque to move or to control a mechanism of a system. The three main types of actuators include pneumatic actuators, hydraulic actuators, and electric actuators.

A gas control actuator is an electric device that controls a piston/valve on a gas line source for purposes of achieving a desired gas flow and gas pressure within the line. Gas actuators are prevalent in the petroleum refinement industry. By injecting gas into the gas line at an acceptable pressure and flow rate, oil is lifted out of an oil well where it can be captured and processed. The gas actuator ensures that the proper gas pressure and gas flow on the gas source line are achieved to keep the oil flowing out of the well for refinement. There are a variety of other variables that must be considered beyond just the gas pressure and flow rate, such as the bottom hole pressure of the oil well, derivate rates of change, etc.

Most gas actuators used in petroleum refinement have minimal processing capabilities; rather, a control device is typically connected to an actuator and used to obtain readings for pressure and temperature, calculate gas flow rates, and send signals to control the actuator for purposes of adjusting the control valve on the gas line. The processing device is an external device to the actuator and is manually operated by a technician, the technician may initiate one or more programs on the processing device for purposes of controlling the control value through the actuator. Typically, a startup process is executed on the external processing device to initiate the flow of oil from the well.

Existing actuators are not intelligent devices with processing capabilities and as such they rely on external processing devices, operators of the external devices, and programs that process on the external devices for the startup procedures of an oil well. Furthermore, it is not just the startup process that requires monitoring as the bottom hole pressure of the oil well has to be monitored to ensure that the oil is optimally flowing from the well as the oil reserves in the well become depleted. The bottom hole pressure monitoring is also dependent on external processing devices, device operators, and device programs. Moreover, conditions can change and sometimes when the conditions warrant the startup process must be reinitiated, which requires intervention by the external processing device and its operator.

The use of external control devices and their operators are not optimal approaches to monitoring and maintaining an expensive oil well. These approaches are also expensive and have high computational load needs.

SUMMARY

In various embodiments, an actuator with embedded processing capabilities for monitoring and optimizing oil well operations are provided. An actuator is provided with an embedded computer that comprises one or more microprocessors that execute firmware instructions. The firmware operates the actuator in three modes of operation for kickoff, optimization, and oil well protection. Kickoff mode is further managed by the firmware as four phases, each phase defined by pressures for gas in the gas injection line and flow rates of the gas in the injection line. Optimization mode is managed by the firmware to maintain an optimal bottom hole pressure of the oil well by increasing and decreasing the gas flow injection rates of the injection line and observing changes in the bottom hole pressure of the oil well. Well protection mode is managed by the firmware by continuously monitoring the pressures and the gas flow rates in the gas injection line such that when a given pressure or a given flow rate is outside of targets defined by each phase of the kickoff mode, the firmware can immediately jump to and initiate a needed phase of the kickoff mode without performing all four phases of the kickoff mode.

DETAILED DESCRIPTION

As stated above, effective management of an oil well requires monitoring a variety of factors, such as gas injection pressure, casing pressure, gas flow rates, temperature of gas within the gas injection line, bottom hole oil well pressure, etc. Temperature is used to calculate the flow. Conventionally, this is achieved to a lot of manual monitoring and externally connected devices to various components of the gas and oil lines. These problems are solved with the teachings presented herein and below.

As will be shown herein and below, an actuator is provided with a motherboard, various daughterboards, and microprocessors that execute firmware. The firmware operates the actuator to achieve the necessary gas pressure and gas flow within the gas injection line through control of the control valve of the gas source line. The firmware initiates a kickoff procedure to initiate the flow of oil in the oil line from the oil well. Following kickoff, the firmware operates in an optimization mode which controls gas injection to achieve an optimal bottom hole pressure. The firmware further operates in a well protection mode that continuously monitors the gas pressures and gas flow rates in the gas injection line and when the pressures and flow rates are below targets the firmware jumps to an appropriate phase in the kickoff. In this way, when there is a slight deviation in pressures or flow, the actuator is capable of jumping directly to the corresponding phase of kickoff to quickly and efficient exit kickoff mode and re-enter the optimization mode. The actuator performs monitoring and adjustments dynamically and as needed without any external device driving the actuator and without any operator manually overseeing and monitoring the pressures and flow rates and manually initiating external processes on the external device.

Figure 1A:
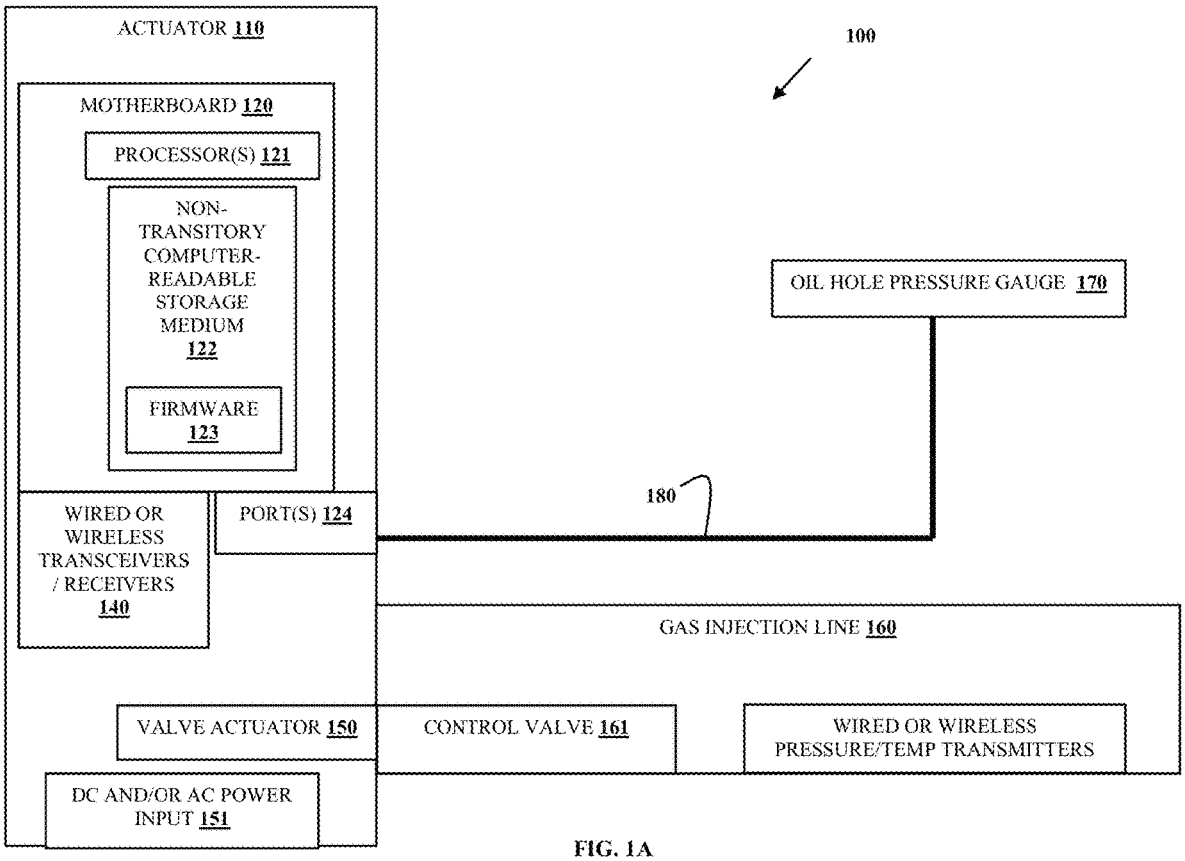
FIG. 1A is a diagram of a system for monitoring and optimizing oil well operations, according to an example embodiment.

FIG. 1A is a diagram of a system 100 for monitoring and optimizing oil well operations, according to an example embodiment. It is noted that the components of system 100 are shown in greatly simplified form with just those components illustrated necessary for understanding the teachings presented herein and below. Thus, system 100 may include more or less components than illustrated without departing from the teachings presented herein and below.

System 100 includes an actuator 110, a gas injection line 160, an oil hole pressure gauge 170, and cabling 180 that connects the oil hole/well pressure gauge from a bottom hole of an oil well 171 (see FIG. 2A). Actuator 110 includes a motherboard 120, wired or wireless transceivers or wired or wireless receivers 140, a valve actuator 150, and direct current (DC) and/or alternating current (AC) power inputs 151. The motherboard 120 includes one or more microprocessors 121 and/or processors 121, a non-transitory computer-readable storage medium 122, firmware instructions within medium 122, and Input/Output (I/O) ports 124, serial ports 124, network ports 124, etc.

Electromechanical components of actuator 110 controls valve actuator 150. Valve actuator 150 is coupled to a control valve 161 of a gas injection line 160. The gas line 160 also includes a variety of pressure and temperature transmitters 160. An oil hole pressure gauge 170 at a bottom of the oil well is connected via cabling 180 to a corresponding port 124 on motherboard 120 of actuator 110.

Most gas lift valve damage occurs as a result of improper or inadequate well startup or kickoff. When kicking off a new gas lift oil well, care must be taken to avoid causing excessive differential pressure across downhole valves. Traditionally, this is achieved by manipulating the gas injection rate with a manual guess-and-check process. While this approach can be effective, it requires manual attention to detail, hours of operator focus, and special knowledge and skillsets for the personnel involved.

Actuator 110 and system 100 eliminates the manual kickoff and operator error through execution of firmware 123 by microprocessor(s) 121. Firmware 123 receives pressures and temperature provided through transmitters 162 of gas injection line 160. Based on the readings associated with the pressure and temperatures and a known diameter of the gas injection line 160, a known orifice diameter, and a known fluid dynamic properties associated with the gas being used, firmware 123 calculates gas flow rates. The pressures, temperature, and flow rates are used by firmware 123 to move valve actuator 150 and correspondingly control valve 161 of gas line 160 to maintain a constant casing pressure rise, targeting configurable pressure and flow milestones along the way. Constant pressure rise is guaranteed by internal proportional integral derivative (PID) control loops working to close the control loop between injecting gas, casing pressure, and choke position. This ensures a controlled kickoff of the oil well and the operations performed by firmware 123 is illustrated and discussed below in FIG. 2 for method 200.

Once the oil well kickoff has exited, firmware 123 enters an optimization mode (shown in FIG. 2 below for method 300). Actuator 110 can be given a flow setpoint which it will maintain with its integral flow PID loop. An operator may also choose to provide through port 124 over cabling 180 bottom hole pressure (BHP) reading provided by bottom hole pressure gauge 170. The BHP reading is used as an additional input by firmware 123 during optimization. This allows firmware 123 to find its own injection setpoint for actuator 110, within an allowable envelope, via the optimization method 300 discussed in FIG. 3 below. In optimization mode, firmware 123 constantly tries to minimize BHP by modulating gas injection through another set of PID loops.

Moreover, at any time firmware 123 detects pressure readings and calculates flow rates that fall below phase level thresholds associated with kickoff, the firmware 123 can autonomously initiate the corresponding phase of kickoff on the oil well through control of the valve actuator. During the monitoring phase, firmware 123 and actuator 110 execute in a well protection mode of operation. This is discussed below in FIG. 4 with method 400. Loss of compression, icing, malfunctioning topside automation etc. can all lead to costly downhole damage if proper well management is not invoked during or shortly after a fault. Well protection mode of operation eliminates this consequence by constantly monitoring well parameters (pressures, temperature, flow rates, etc.) and reinitiating kickoff if critical conditions are met. Well protection mode can be autonomously initiated by firmware 123 during any mode of operation (auto, manual, optimization, etc.).

Figure 1B:
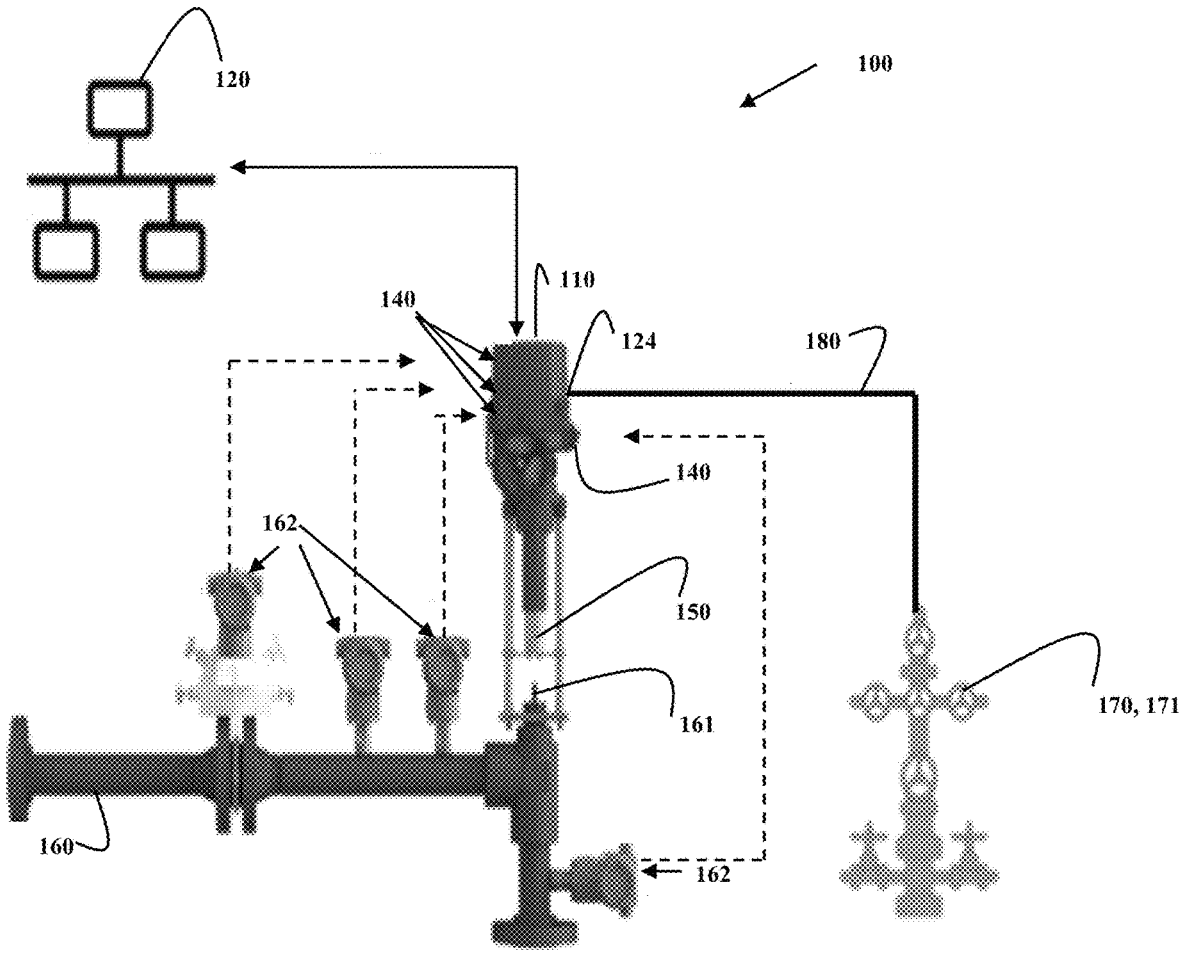
FIG. 1B is another diagram of the system depicted in FIG. 1, according to an example embodiment.

FIG. 1B is another diagram of the system 100 depicted in FIG. 1, according to an example embodiment. FIG. 1B provides a visual rendering of system 100. Motherboard 120 is embedded inside actuator 110 as illustrated by the double arrow. Gas injection line 160 includes four sensors and transmitters 162 for a differential pressure gauge/sensor and transmitter 162 (leftmost transmitter 162 in FIG. 1B), a static pressure gauge/sensor and transmitter 162 (adjacent to the right of the differential pressure in FIG. 1B), a temperature gauge/sensor and transmitter 162 (adjacent to the right of the static pressure in FIG. 1B), and a casing pressure gauge/sensor and transmitter 162 (rightmost transmitter 162 in FIG. 1B).

Gas injection line 160 includes control valve 161 which is controlled by valve actuator 150 through firmware 123 of motherboard 120. Wired or wireless receivers 140 of actuator 110 receive the corresponding pressure and temperature readings from transmitters 162. Oil well 171 includes BHP gauge 171 connected via cabling 180 to a corresponding port 124 on motherboard 120.

In an embodiment, motherboard 120 includes a flow computer or is interfaced through a port or bus connection to a flow computer. The flow computer directly calculates gas flow rates on behalf of firmware 123 for the gas line 160 from the differential pressure reading, static pressure reading, temperature reading, known fluid dynamic and molecular properties of gas used in the gas injection line 160, and known diameters of the gas injection line and orifice line.

In an embodiment, the inputs to firmware 123 include differential pressure, static pressure, casing pressure, temperature, and bottom hole pressure (BHP). In an embodiment, a serial port 124 of actuator 110 is Modbus RTU or TCP to permit settings used by firmware 123 to be remotely provided.

In an embodiment, firmware 123 combines multiple PID loops configured appropriately at different times to accomplish desired performance characteristics for gas lift processes of the oil well. The performance characteristics include valve activator 150 position and corresponding control valve position 161, gas injection flow rate, casing pressure rise, bottom hole pressure.

In an embodiment, the gas source is for the gas injection line 160 is natural gas, casinghead gas (gas that collects in the annular space between the casing and tubing in the oil line cycled back into the gas injection line 160), carbon dioxide, or any other gas used for purposes of artificial lift, and/or any combination of these gases.

The three modes of operation for kickoff, optimization, and well protection of firmware 123 are now discussed with reference to FIGS. 2-4 and methods 200-400.

Figure 2:
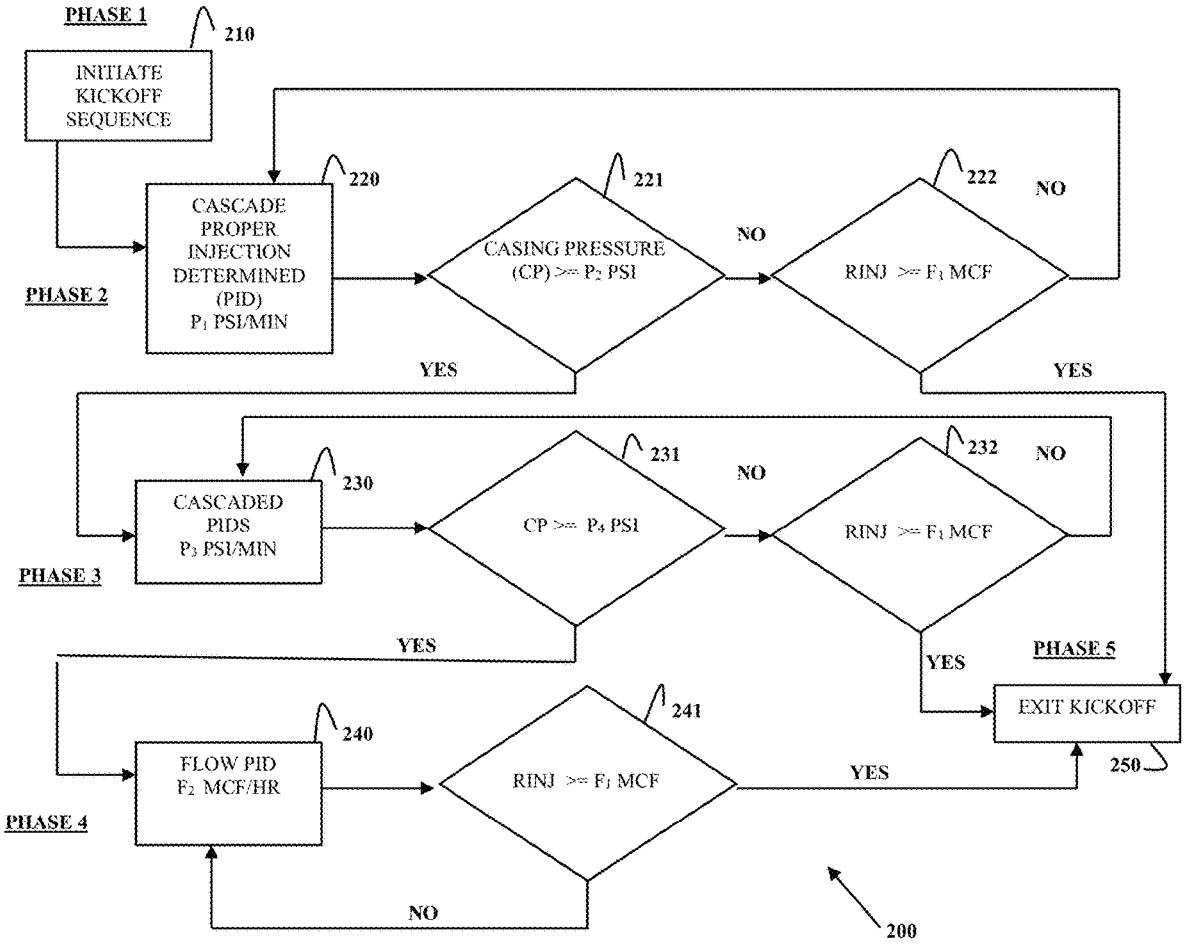
FIG. 2 is a diagram a method processed by firmware of an actuator to perform kickoff initiation on an oil well, according to an example embodiment.

FIG. 2 is a diagram of a method 200 processed by firmware 123 of an actuator 110 to perform kickoff initiation on a gas lift assisted oil well, according to an example embodiment. The actuator 110 includes a motherboard 120 which includes one or more microprocessors 121 that execute the firmware 123 on the motherboard 120, which is embedded in a housing of the actuator 110. Method 200 represents actuator 110 operating in a kickoff mode of operation, when kickoff mode is exited, firmware 123 transitions to an auto mode or an optimization mode of operation as described below in FIG. 3 with method 300.

Method 200 is a set of PID loops processed as independent phases by firmware 123. A first phase 210 initiates the kickoff sequence for an oil well, this phase may only require execution when the oil well is first brought online. A second phase 220-222 obtains $P_1$ for casing pressure, obtains $P_2$ the casing pressure target ($P_2$), and obtains $F_1$ the max gas flow injection rate measured in MCF (thousand cubic feet). A third phase 230-232 obtains $P_3$ for casing pressure, obtains the casing pressure target ($P_4$), and obtains $F_1$. A fourth phase 240-241 and obtains $F_2$ gas flow injection rate. The method 200 is exited and auto mode or optimization mode (discussed below with FIG. 3 and method 300) when the resulting gas flow injection (RINJ) is greater than or equal to $F_1$ in the second phase, $F_1$ in the second phase, or $F_2$ in the fourth phase.

At 210, firmware 123 initiates the kickoff mode of operation for actuator 110. Again, this phase 1 may only need to be executed when the oil well is first brought online to being pumping oil from the oil well. Phase 2 is immediately initiated.

At 220, firmware 123 executes phase 2 by first obtaining $P_1$ as pressure per min measured in pounds per square inch (PSI)/minute (min); $P_1$ as a setpoint. At 221, the firmware 123 checks to see if the casing pressure (CP) is greater than or equal to $P_2$. $P_2$ is a target setting for phase 2 that the CP should be at to exit phase 2 of kickoff. If $CP>=P_2$, then firmware 123 jumps directly to phase 3, at 230, if $CP<P_2$ then, at 222, firmware 123 checks to determine if the resulting gas injection (RINJ) was $>=F_1$. When $RINJ>=F_1$, firmware 123 exits at 250 and auto mode or optimization mode (see method 300 and FIG. 3 below) is initiated. When $RINJ<F_1$, firmware 123 loops back to 220 to increase the gas injection until kickoff can be exited at 250 or until phase 3 can be started at 230.

Assuming phase 3 is initiated, at 230, firmware 123 obtains a $P_3$ setpoint and checks, at 231, if $CP>=P_4$. When $CP>=P_4$, firmware 123 jumps to phase 4 at 240. When $CP<P_4$ checks, at 232, to see if $RINJ>=F_1$, and if true exits kickoff mode at 250 otherwise firmware 123 loops back to 230 until phase 4 can be entered or kickoff exited.

Figure 3:
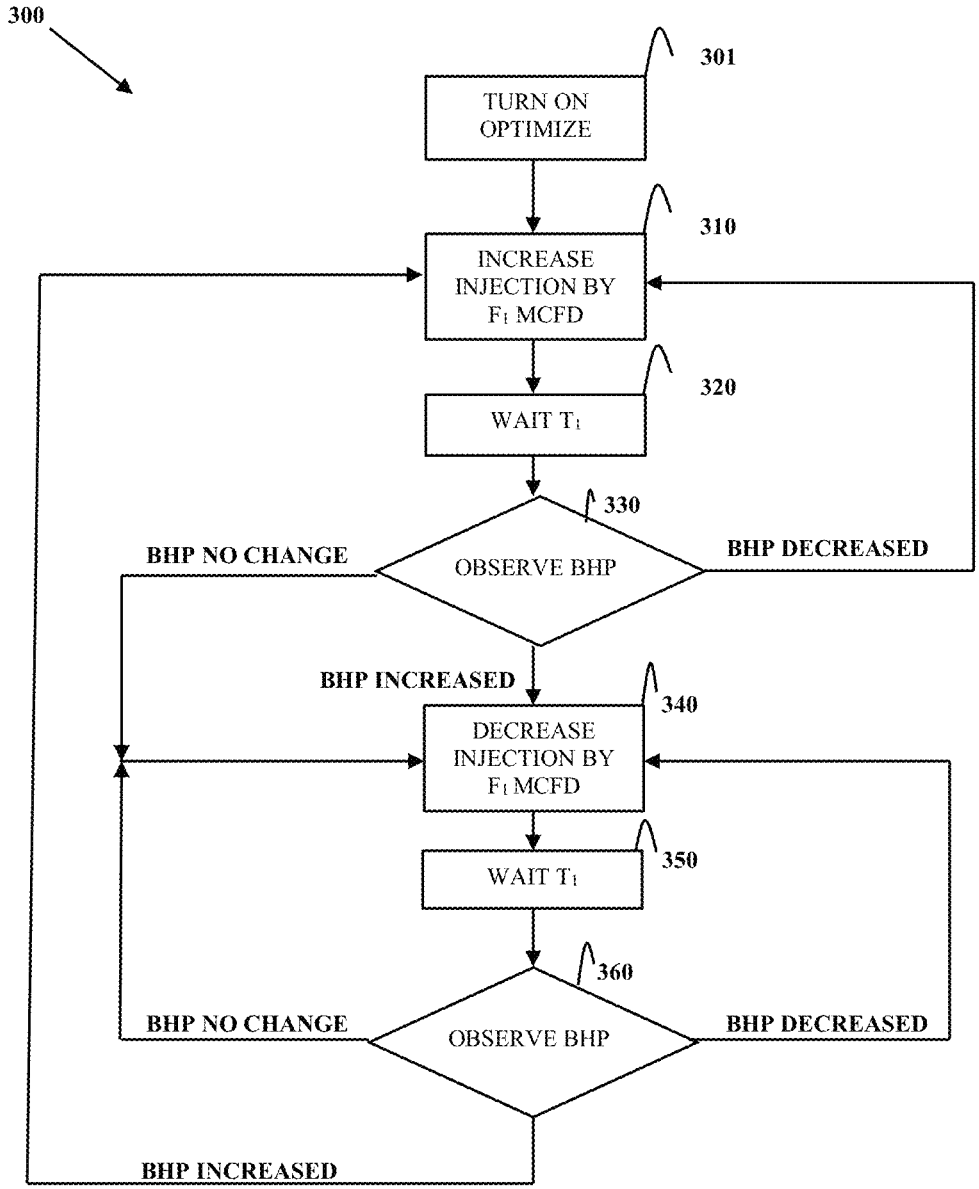
FIG. 3 is a diagram of a method processed by firmware of an actuator to perform optimization monitoring on the oil well, according to an example embodiment.

Assuming phase 4 is initiated, at 240, firmware 123 obtains a $F_2$ MCF/hour(HR) checkpoint and checks to see if $RINJ>=F_1$ which if true causes firmware to exit kickoff at 250 and auto mode or optimization mode is started (FIG. 3 and method 300 below). When $RINJ<F_1$, firmware loops back to 240 until kickoff is exited at 250.

FIG. 3 is a diagram of a method 300 processed by firmware 123 of an actuator 110 to perform optimization monitoring on the oil well, according to an example embodiment. Again, the actuator 110 includes a motherboard 120 which includes one or more microprocessors 121 that execute the firmware 123 on the motherboard 120, which is embedded in a housing of the actuator 110. Method 300 represents an optimization mode of operation for the actuator 110 and is entered following exit of the kickoff mode of operation described above with FIG. 2 and method 200 or on command by the operator.

At 301, firmware 121 is turned on, this can be done automatically following kickoff mode of operation or can be done manually through a setting provided through port 124. At 310, firmware 123 increases injection by $F_1$ MCFD. At 320, firmware 123 waits a preconfigured amount of time Ti to check results to the BHP of the oil well.

At 330, firmware 123 checks the BHP to determine if there was any change. If BHP decreases, firmware 123 loops back to 310. If BHP had no change or increases, firmware 123 decreases gas injection by $F_1$ MCFD at 340. At 350, firmware waits again for Ti amount of time to see results, if any, from the decrease in gas injection by $F_1$. At 360, firmware 123 observes the BHP, when BHP decreased or had no change, firmware 123 loops back to 340 to again lower the gas injection by $F_1$ MCFD. If BHP increases, firmware 123 loops back to 310.

Optimization continuously runs to maintain a maintenance free optimal BHP for the oil well. However, optimization mode can be exited and thrown back into kickoff mode when firmware 123 detects pressures and flow rates below set thresholds established for the four phases of kickoff. This occurs when firmware 123 is operating in a well protection mode of operation described below in FIG. 4 and method 400.

Figure 4:
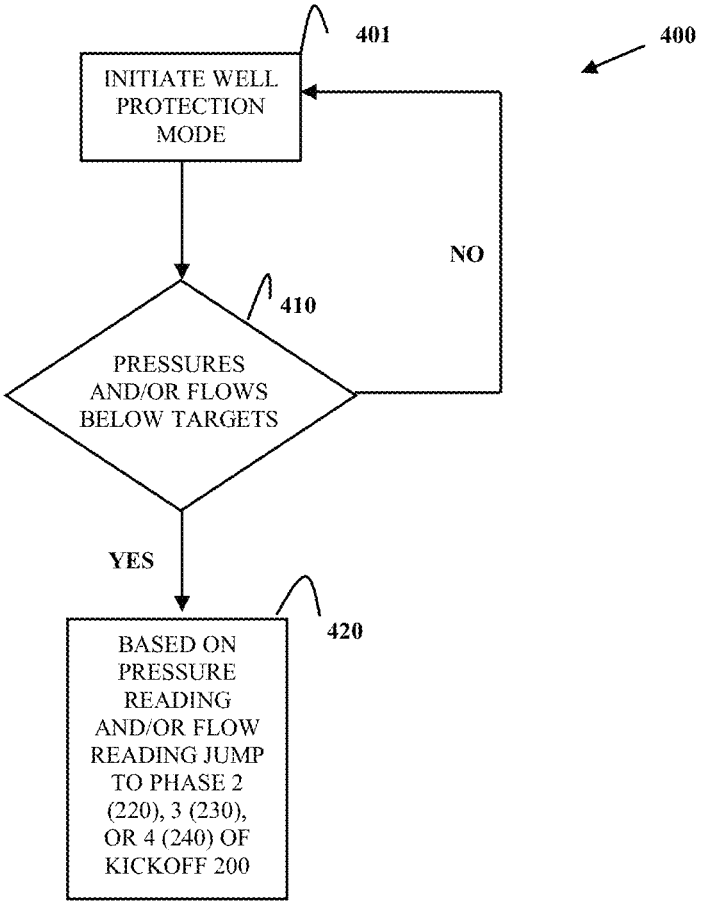
FIG. 4 is a diagram of a method processed by firmware of an actuator to perform well protection monitoring on the oil well, according to an example embodiment.

FIG. 4 is a diagram of a method 400 processed by firmware 123 of an actuator 110 to perform well protection monitoring on the oil well, according to an example embodiment. The actuator 110 includes a motherboard 120 which includes one or more microprocessors 121 that execute the firmware 123 on the motherboard 120, which is embedded in a housing of the actuator 110. Method 400 represents a well protection mode of operation for the actuator 110 and is entered of is continuously processed following exiting of the kickoff mode of operation described above with FIG. 2 and method 200.

At 401, firmware 123 initiates well protection mode of operation. At 410, firmware 123 checks pressures and/or flow rates that are below thresholds or outside of preconfigured ranges associated with phases 2-4 of the kickoff mode of operation (method 200).

Based on the captured pressures and flow rates, at 420, firmware 123 jumps directly to phase 2 of kickoff (220), phase 3 of kickoff (230), or phase 4 (240) of kickoff. That is, the observed pressures and calculated flow rates determine which phase of kickoff is processed. This means that not all the phases have to be reprocessed; rather, firmware 123 directly jumps to the needed phase of kickoff based on current pressures and current calculated flow rates.

Well protection mode can be processed after kickoff and concurrently with optimization mode or any other mode of operation for the actuator 110.

In an embodiment, optimization mode is optional and can be turned off via settings through port 124.

In an embodiment, well protection mode is optional and can be turned off via settings through port 124.

In an embodiment, kickoff mode is executed by firmware 123 when the oil well is first brought online and by default when kickoff mode exits, firmware 123 initiates auto mode or optimization mode. Concurrently, firmware 123 operates in well protection mode during the optimization mode. Any fault detected causes well protection mode to evaluate and determine which phase of the kickoff mode to jump to.

In an embodiment, each of the three modes of operation can be set in default settings retained in non-transitory computer-readable storage medium of actuator 110. The settings can be obtained via port 124 from an external computing device. The threshold for flow rates, gas injection increase rates, and pressure rates can also be changed via the settings using an external computing device connected to port 124.

In an embodiment, the settings are viewed and changed via a mobile computing device that connects to the actuator via a wired or a wireless transceiver 140. An interface set of executable instructions of actuator 110 can provide an interface for viewing existing settings and thresholds can changing them as desired. In this embodiment, a wired connection between the device and the actuator 110 is not needed.

Figure 5:
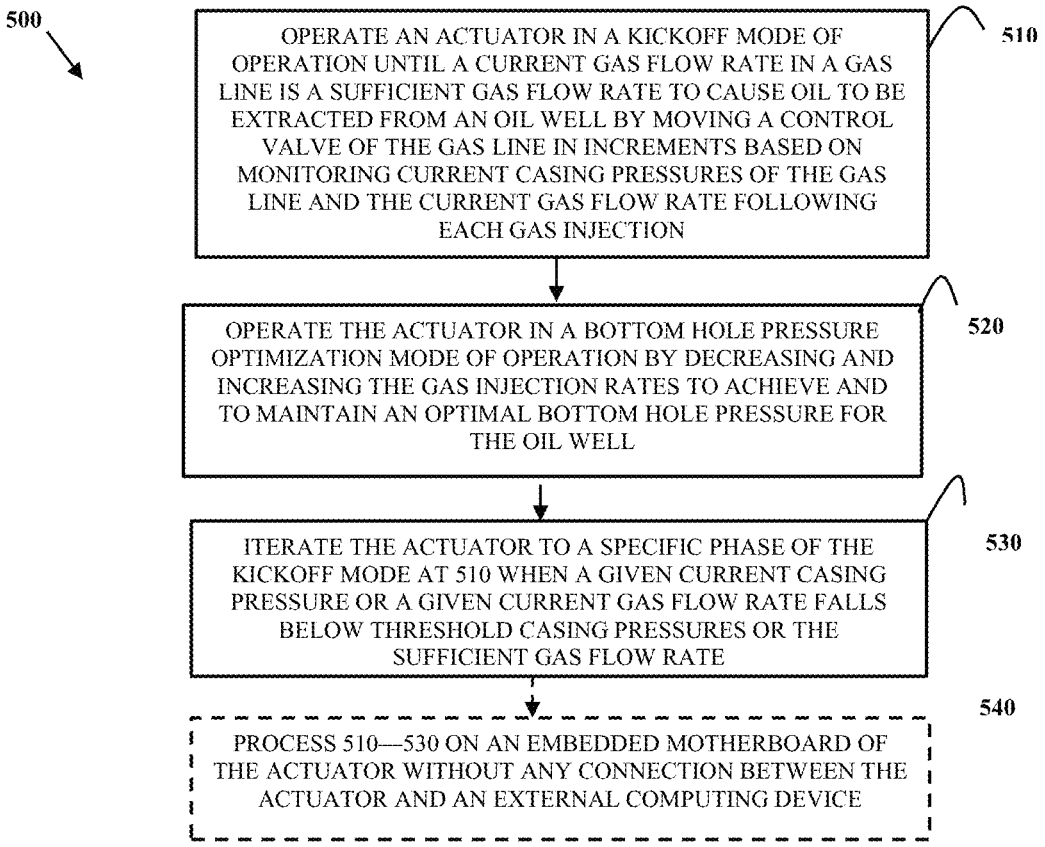
FIG. 5 is a diagram of a method processed by firmware of an actuator to perform kickoff initiation, optimization monitoring, and well protection monitoring, according to an example embodiment.

FIG. 5 is a diagram of a method 500 processed by firmware 123 of an actuator 110 to perform kickoff initiation (method 200), optimization monitoring (method 300), and well protection monitoring (method 400), according to an example embodiment.

At 510, firmware 123 operators an actuator 110 in a kickoff mode of operation (method 200) until a current gas flow rate in a gas line is a sufficient gas flow rate to cause oil to be extracted from an oil well. Firmware 123 controls electromechanical components of the actuator to move a control valve of the gas line in increments based on monitoring current casing pressures and the current gas flow rate following each gas injection.

At 520, firmware 123 operates the actuator 110 in a BHP optimization mode of operation (method 300). This is done by decreasing and increasing the gas injection rates of gas into the gas line to achieve and to maintain an optimal BHP for the oil well.

At 530, firmware 123 iterates the actuator to a specific phase of the kickoff mode of operation at 510 when a given current casing pressure or a given current gas flow rate falls below threshold casing pressures or the sufficient gas flow rate. This is the well protection mode of operation (method 400) discussed above. Moreover, the phases were identified above as a first phase 210, a second phase 220, a third phase 230, and a fourth phase 240 in the description above provided for the kickoff mode of operation and method 200. For example, if the given current casing pressure is below $P_1$ (a first threshold casing pressure), firmware 123 jumps directly to 220 of method 200; if the given casing pressure is above $P_1$ but below $P_2$, firmware 123 jumps directly to 230 of method 200; and if the given casing pressure above $P_2$ but the given current gas flow rate is below $F_1$, firmware 123 jumps directly to 240 of method 200.

In an embodiment, at 540, firmware 123 (510-530) processes on an embedded motherboard 120 of the actuator 110 without any connection being required between the actuator 110 and an external computing device.

One now appreciates how an intelligent and processing enabled actuator 110 can initiate, optimize, monitor, and maintain an oil well conditions through control of the gas injection into the gas line using pressures, temperatures, and gas flow rates of the gas in the gas line. The teachings do not require manual personnel oversight nor do the teachings require a connection to an external computing device and any software that processes thereon. Essentially, operator-free oil well operations can be achieved with the teachings provided herein and above.

Although the present invention has been described with particular reference to certain preferred embodiments thereof, variations and modifications of the present invention can be affected within the spirit and scope of the following claims.

The invention claimed is:

1. An actuator, comprising:

a valve actuator adapted to couple to a control valve of a gas injection line of an oil well;

a motherboard embedded in the actuator;

the motherboard comprises at least one microprocessor and a non-transitory computer-readable storage medium;

the non-transitory computer-readable storage medium comprises firmware instructions; and the firmware instructions when executed by the at least one microprocessor from the non-transitory computer-readable storage medium cause the microprocessor to perform operations comprising:

controlling the valve actuator to move the control valve of the gas injection line during a kickoff mode of operation for the actuator causing changes in current pressures and current gas flow rates in the gas injection line to achieve target pressures and target gas flow rates; and processing the kickoff mode of operation in four independent and interconnected phases using the controlling and based on the target pressures and the target gas flow rates in view of the changes in the current pressures and the current gas flow rates caused by the controlling.

2. The actuator of claim 1, wherein the operations further include:

controlling the valve actuator to move the control valve during an optimization mode of operation for the actuator causing increases and decreases in the current gas flow rates within the gas injection line based on observed bottom hole pressures for the oil well after each of the increases and each of the decreases in the current gas flow rates.

3. The actuator of claim 1, wherein the operations further include:

monitoring the current pressures and the current gas flow rates during a well protection mode of operation for the actuator; and processing a specific one of the four independent and interconnected phases of the kickoff mode of operation based on a given current pressure and a given current gas flow rate in the gas injection line.

4. The actuator of claim 1, wherein the operations associated with the processing further include processing a phase 1 and initiating the kickoff mode of operation, processing a phase 2 when a casing pressure for the gas injection line is below a first pressure target, processing a phase 2 when the casing pressure is below a second pressure target, and processing a phase 4 when a given current gas flow rate is below a target gas flow rate.

5. The actuator of claim 4, wherein the operations associated with the processing further include exiting the kickoff mode of operation for the actuator during the phase 2, the phase 3, or the phase 4 when the given current gas flow rate is at or above the target gas flow rate.

6. The actuator of claim 5, wherein the operations associated with the processing further include looping back to a start of the phase 2 when the casing pressure is less than the first pressure target and when the given current gas flow rate is below the target gas flow rate.

7. The actuator of claim 6, wherein the operations associated with the processing further include jumping from the phase 2 to a start of the phase 3 when the casing pressure in the phase 2 is greater than the first pressure target.

8. The actuator of claim 7, wherein the operations associated with the processing further include looping back to the start of the phase 3 when the casing pressure is less than the second pressure target and when the given current gas flow rate is below the target gas flow rate.

9. The actuator of claim 8, wherein the operations associated with the processing further include jumping from the phase 3 to a start of the phase 4 when the casing pressure in the phase 3 is greater than the second pressure target.

10. The actuator of claim 9, wherein the operations associated with the processing further include looping back to the start of phase 4 until the given current gas flow rate is at or above the target gas flow rate.

11. The actuator of claim 1 further comprising:

one or more wired or wireless receivers adapted to obtain a differential pressure from a differential pressure transmitter of the gas injection line, a static pressure from a static pressure transmitter of the gas injection line, a temperature from a temperature transmitter of the gas injection line, and a casing pressure from a casing pressure transmitter of the gas injection line.

12. The actuator of claim 11 further comprising:

one or more ports on the motherboard to receive a bottom hole pressure from a pressure gauge in the oil well and to receive settings that are at least associated with the target pressures and target gas flow rates from a device.

13. A system, comprising:

a control valve of a gas injection line configured to control gas injected into the gas line for extracting oil from an oil well;

a bottom hole pressure gauge situated in a bottom of the oil well; and a gas actuator that comprises:

a valve actuator coupled to the control valve and configured to control movements of the control valve;

a motherboard embedded in the gas actuator that comprises:

at least one microprocessor and a non-transitory computer-readable storage medium;

the non-transitory computer-readable storage medium comprises firmware; and the firmware when executed by the at least one microprocessor from the non-transitory computer-readable storage medium causes the at least one microprocessor to perform operations comprising:

controlling the control valve through the valve actuator to control gas injection rates of the gas into the gas line; and using the controlling to operate the actuator in a kickoff mode of operation to obtain a sufficient casing pressure for the gas line and a sufficient gas flow rate for the gas line to initiate extraction of oil from the oil well, a bottom hole pressure optimization mode of operation for a bottom hole pressure provided from the bottom hole pressure gauge to maintain an optimal bottom hole pressure for the oil well, and a well protection mode of operation that monitors current casing pressures and current gas flow rates within the gas line and initiates one of four phases of the kickoff mode of operation based on threshold casing pressures and a threshold gas flow rate, each threshold casing pressure associated with a specific one of the four phases of the kickoff mode of operation.

14. The system of claim 13 further comprising, a differential pressure transmitter on the gas line to transmit a current differential pressure of the gas line to the actuator, a static pressure transmitter to transmit a current static pressure of the gas line to the actuator, a temperature transmitter to transmit a current temperature of the gas line to the actuator, and a casing pressure transmitter on the gas line to transmit a current casing pressure to the actuator.

15. The system of claim 14, wherein the actuator further includes one or more wired or wireless receivers for receiving the current differential pressure, the current static pressure, the current temperature, and the current pressure from the transmitters on the gas line.

16. The system of claim 15 further comprising, a first port of the motherboard to receive current bottom hole pressures from the bottom hole pressure gauge.

17. The system of claim 16 further comprising, a second port of the motherboard to receive settings that are at least associated with the threshold casing pressures and the threshold gas flow rate.

18. The system of claim 13, wherein the actuator further includes an embedded flow computer configured to directly calculate the current gas flow rates and provide the current gas flow rates to the firmware for processing with the operations.

19. A method, comprising:

operating an actuator in a kickoff mode of operation until a current gas flow rate for gas in a gas line is a sufficient gas flow rate to cause oil to be extracted from an oil well by moving a control valve of the gas line to change gas injection rates into the gas line in increments based on monitoring current casing pressures of the gas line and the current gas flow rate following each gas injection;

operating the actuator in a bottom hole pressure optimization mode of operation by decreasing and increasing the gas injection rates to achieve and to maintain an optimal bottom hole pressure for the oil well; and iterating the actuator to a specific phase of the kickoff mode of operation when a given current casing pressure or a given current gas flow rate falls below threshold casing pressures or the sufficient gas flow rate.

20. The method of claim 19 further comprising, processing the method on an embedded motherboard of the actuator without any connection between the actuator and an external computing device.

* * * * *